US011162260B2

(12) United States Patent
Pryor

(10) Patent No.: US 11,162,260 B2
(45) Date of Patent: Nov. 2, 2021

(54) MOMENT FRAME INCLUDING LATERAL BRACING SYSTEM AND COPED BEAM

(71) Applicant: Simpson Strong-Tie Company Inc., Pleasanton, CA (US)

(72) Inventor: Steven E. Pryor, Dublin, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

(21) Appl. No.: 16/595,940

(22) Filed: Oct. 8, 2019

(65) Prior Publication Data

US 2020/0109556 A1 Apr. 9, 2020

Related U.S. Application Data

(60) Provisional application No. 62/743,176, filed on Oct. 9, 2018.

(51) Int. Cl.

| | |
|---|---|
| ***E04B 1/98*** | (2006.01) |
| ***E04H 9/02*** | (2006.01) |
| ***E04B 1/24*** | (2006.01) |
| ***E04C 3/06*** | (2006.01) |

(52) U.S. Cl.

CPC ..... *E04B 1/98* (2013.01); *E04B 1/2403* (2013.01); *E04C 3/06* (2013.01); *E04H 9/024* (2013.01); *E04B 2001/2415* (2013.01); *E04B 2001/2442* (2013.01); *E04B 2001/2457* (2013.01)

(58) Field of Classification Search

CPC ..... E04H 9/024; E04B 1/98; E04B 1/2403; E04B 2001/2457; E04B 2001/2415; E04B 2001/2442; E04B 2001/2445; E04B 2001/2448; E04C 3/06; E04C 5/0645

See application file for complete search history.

(56) References Cited

U.S. PATENT DOCUMENTS 4,696,137 A * 9/1987 Schleich ..... E04B 1/2403 52/251
6,474,902 B1 * 11/2002 Beauvoir ..... F16B 9/058 403/403
6,739,099 B2 * 5/2004 Takeuchi ..... E04B 1/2403 403/403

(Continued)

FOREIGN PATENT DOCUMENTS

CN 103114733 A 5/2013
EP 2468986 A2 6/2012

(Continued)

OTHER PUBLICATIONS

International Search Report and Written Opinion dated Jan. 16, 2020 in International Patent Application No. PCT/US2019/055344.

*Primary Examiner* — Brent W Herring
(74) *Attorney, Agent, or Firm* — Vierra Magen Marcus LLP

(57) ABSTRACT

A construction formed of column and a beam, where the beam has top and bottom flanges coupled to the column by a lateral bracing system, and a web between the top and bottom flanges. The lateral bracing system may include a column-mounted plate including a horizontal portion and a vertical portion, the vertical portion affixed to the column. The beam may be coped at top and bottom edges of the web to prevent binding of the beam flange with the column-mounted plate upon rotation of the beam relative to the column.

5 Claims, 7 Drawing Sheets

(56) References Cited

U.S. PATENT DOCUMENTS

| | | | | |
|---|---|---|---|---|
| 7,497,054 | B2 * | 3/2009 | Takeuchi | E04B 1/2403 403/403 |
| 8,074,359 | B2 * | 12/2011 | Bong | B23K 33/004 29/897.3 |
| 10,669,718 | B2 * | 6/2020 | Pryor | E04C 3/04 |
| 10,697,192 | B2 * | 6/2020 | Richard | E04H 9/027 |
| 2002/0184836 | A1 * | 12/2002 | Takeuchi | E04C 3/04 52/167.1 |
| 2004/0187430 | A1 * | 9/2004 | Takeuchi | E04B 5/10 52/837 |
| 2004/0244330 | A1 * | 12/2004 | Takeuchi | E04B 1/2403 52/831 |
| 2005/0257451 | A1 * | 11/2005 | Pryor | E04H 9/14 52/167.4 |
| 2006/0144006 | A1 * | 7/2006 | Suzuki | E04H 9/024 52/655.1 |
| 2010/0205891 | A1 * | 8/2010 | Bong | B23K 33/004 52/655.1 |
| 2019/0292783 | A1 * | 9/2019 | Pryor | E04B 1/2403 |
| 2019/0330873 | A1 * | 10/2019 | Richard | E04H 9/024 |
| 2020/0291653 | A1 * | 9/2020 | Pryor | E04C 3/38 |

FOREIGN PATENT DOCUMENTS

| | | | | |
|---|---|---|---|---|
| JP | 2002371626 | A | 12/2002 | |
| JP | 2004278293 | A * | 10/2004 | E04H 9/024 |

* cited by examiner

MOMENT FRAME INCLUDING LATERAL BRACING SYSTEM AND COPED BEAM

PRIORITY DATA

This application claims priority to U.S. Provisional Patent Application No. 62/743,176, entitled "MOMENT FRAME INCLUDING LATERAL BRACING SYSTEM AND COPED BEAM", filed Oct. 9, 2018, which application is incorporated herein by reference in its entirety.

BACKGROUND OF THE INVENTION

Field of the Invention

The present invention relates to hysteretic damping for structures used in light-framed constructions, and in particular to a lateral bracing system constructed to provide a high degree of energy dissipation through hysteretic damping along with high initial stiffness so that energy is dissipated at low displacement thresholds within a light-framed construction.

Description of the Related Art

Shear stresses due to natural phenomena such as seismic activity and high winds can have devastating effects on the structural integrity of light-framed constructions. Lateral forces generated during such natural phenomena may cause the top portion of a wall to move laterally with respect to the bottom portion of the wall, which movement can result in damage or structural failure of the wall and, in some instances, collapse of the building.

In constructions such as residences and small buildings, lateral bracing systems were developed to counteract the potentially devastating effects of shear stress on the structural integrity of light-framed constructions. Although various designs are known, one type of lateral bracing system includes vertical studs spaced from each other and horizontal beams affixed to and extending between the studs. The beams are affixed to the studs in a manner aimed at increasing structural performance of the connection under lateral loads.

Many conventional lateral bracing systems perform well initially under lateral loads, but yield and fail upon the repetitive lateral loads which often occur during significant seismic activity and high winds. Upon appreciable yield or failure of the lateral bracing system, the entire system must be replaced.

Another consideration relates to clearances of components with respect to each other as the beam rotates relative to the column under lateral loads.

DETAILED DESCRIPTION

Figure 1:
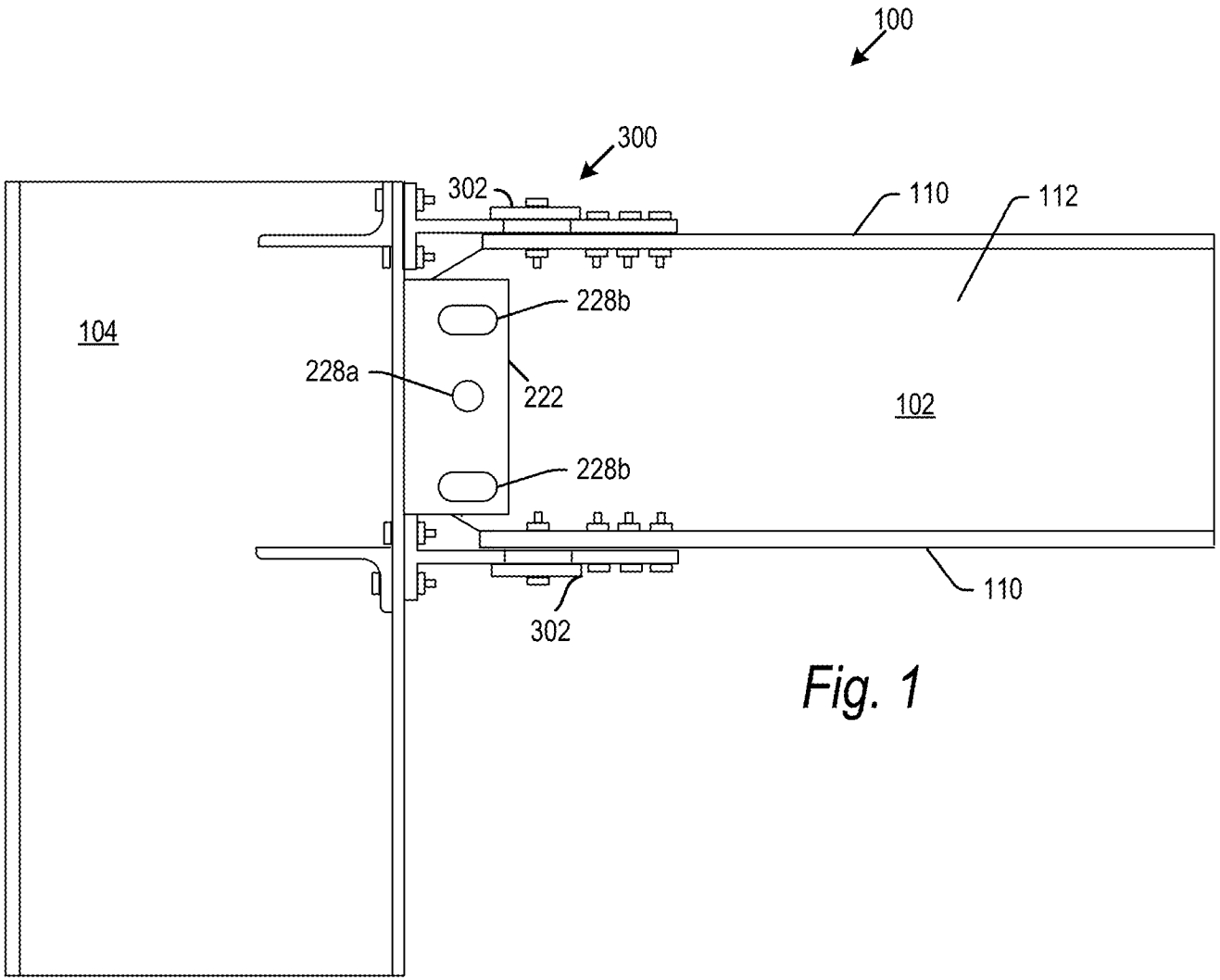
FIG. 1 is a front view of a beam connected to a column by a lateral bracing system according to an embodiment of the present invention.
Figure 2:
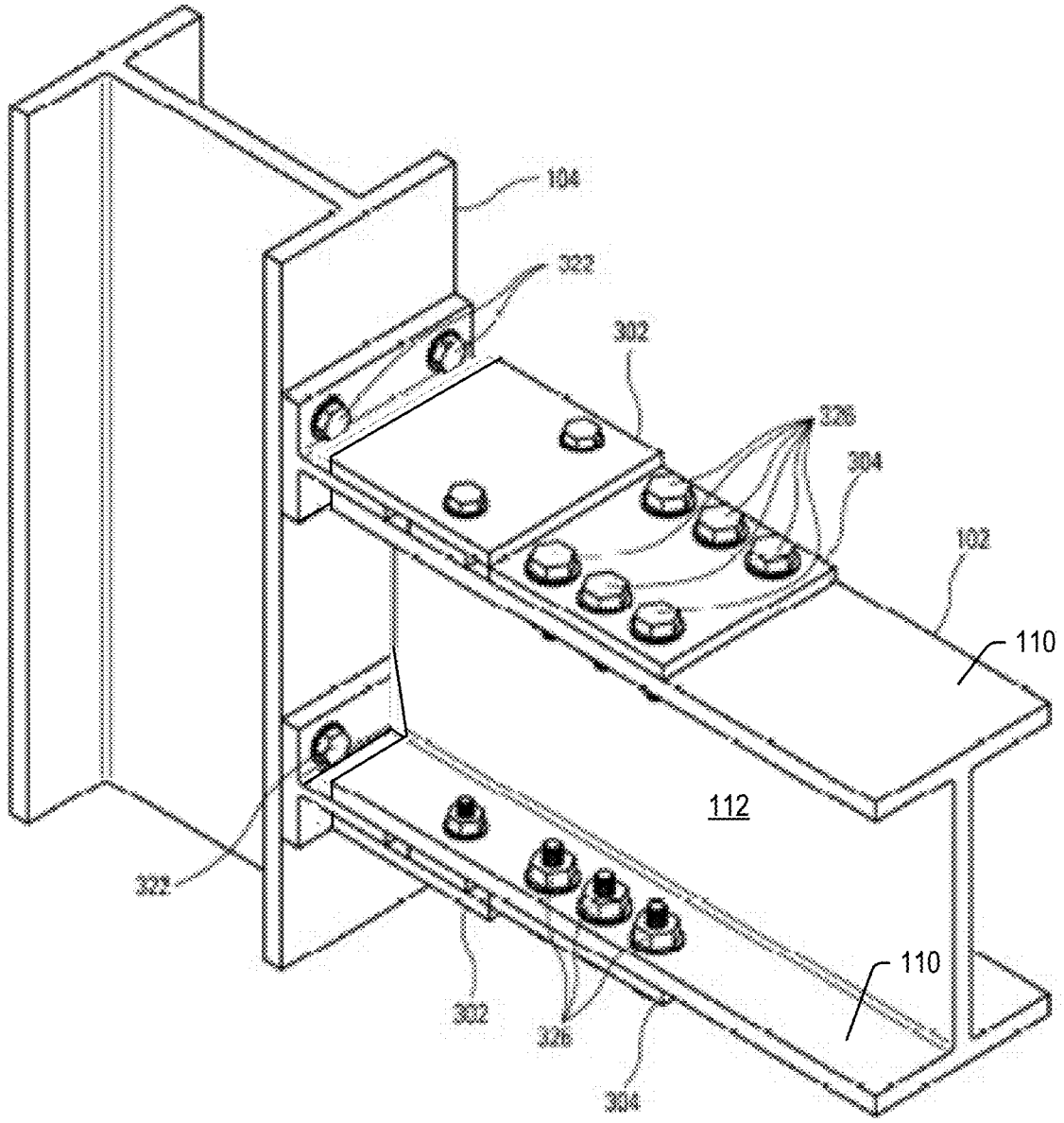
FIG. 2 is a perspective view of a beam connected to a column by a lateral bracing system according to an embodiment of the present invention.
Figure 3:
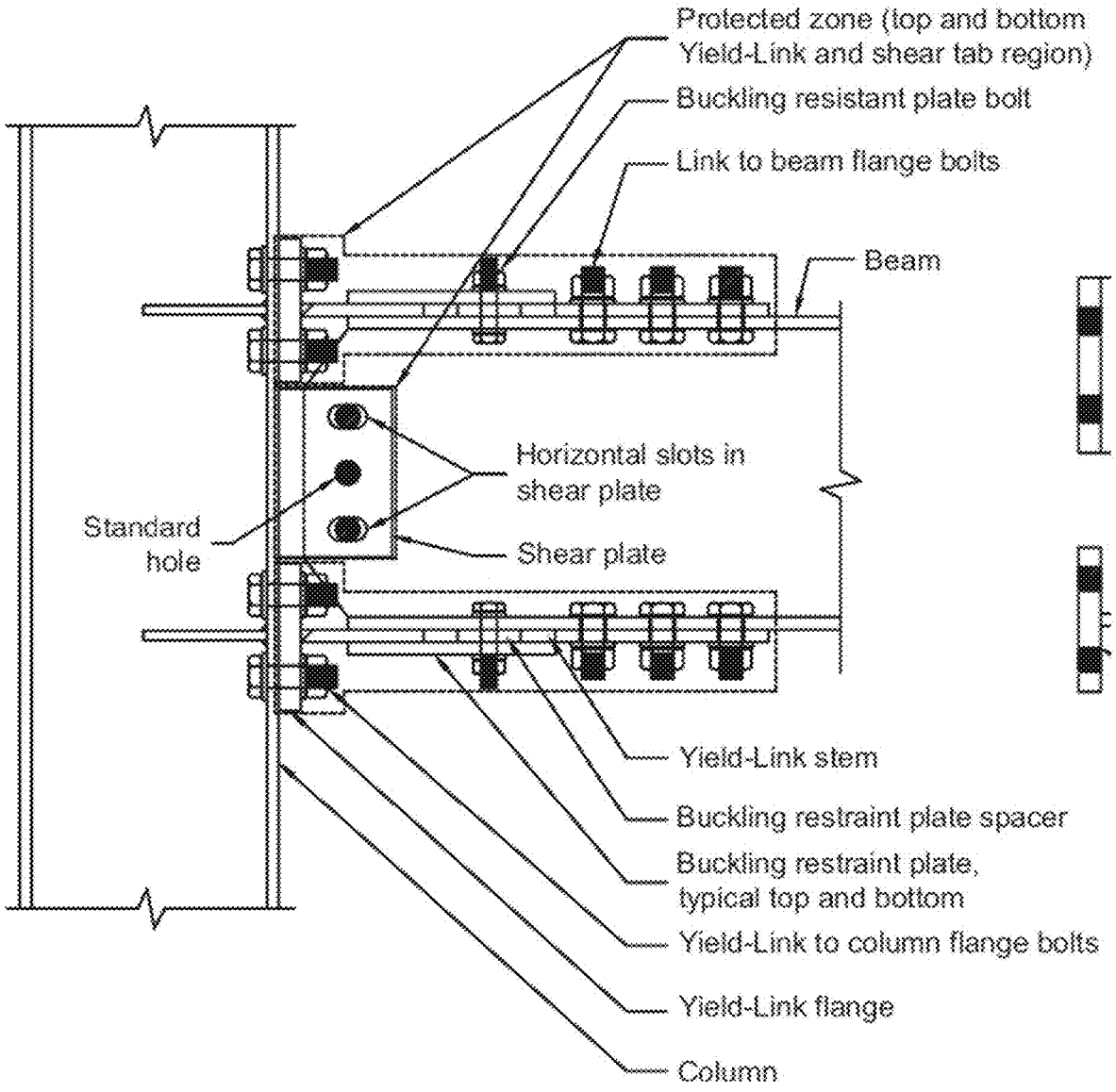
FIG. 3 is a front view of a beam connected to a column by a lateral bracing system and a shear tab according to an embodiment of the present invention.

The present invention will now be described with reference to the figures, which in embodiments relate to a lateral bracing system having high initial stiffness and including yield links capable of effectively dissipating energy generated within the lateral bracing system under lateral loads. It is understood that the present invention may be embodied in many different forms and should not be construed as being limited to the embodiments set forth herein. Rather these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

Referring now for example to FIGS. 1-3 and 7, there is shown a frame 100 comprised in part of a horizontal beam 102 affixed to a vertical column 104. Each of the beam 102 and column 104 includes an opposed pair of flanges connected by a central diaphragm or web. Beam 102 may for example include flanges 110 and web 112. Although referred to as a vertical column and a horizontal beam, it is understood that the column and beam may be affixed to each other at angles other than 90° in alternative embodiments. The beam 102 and column 104 may be I-beams, W-beams or other structural steel components.

Figure 7:
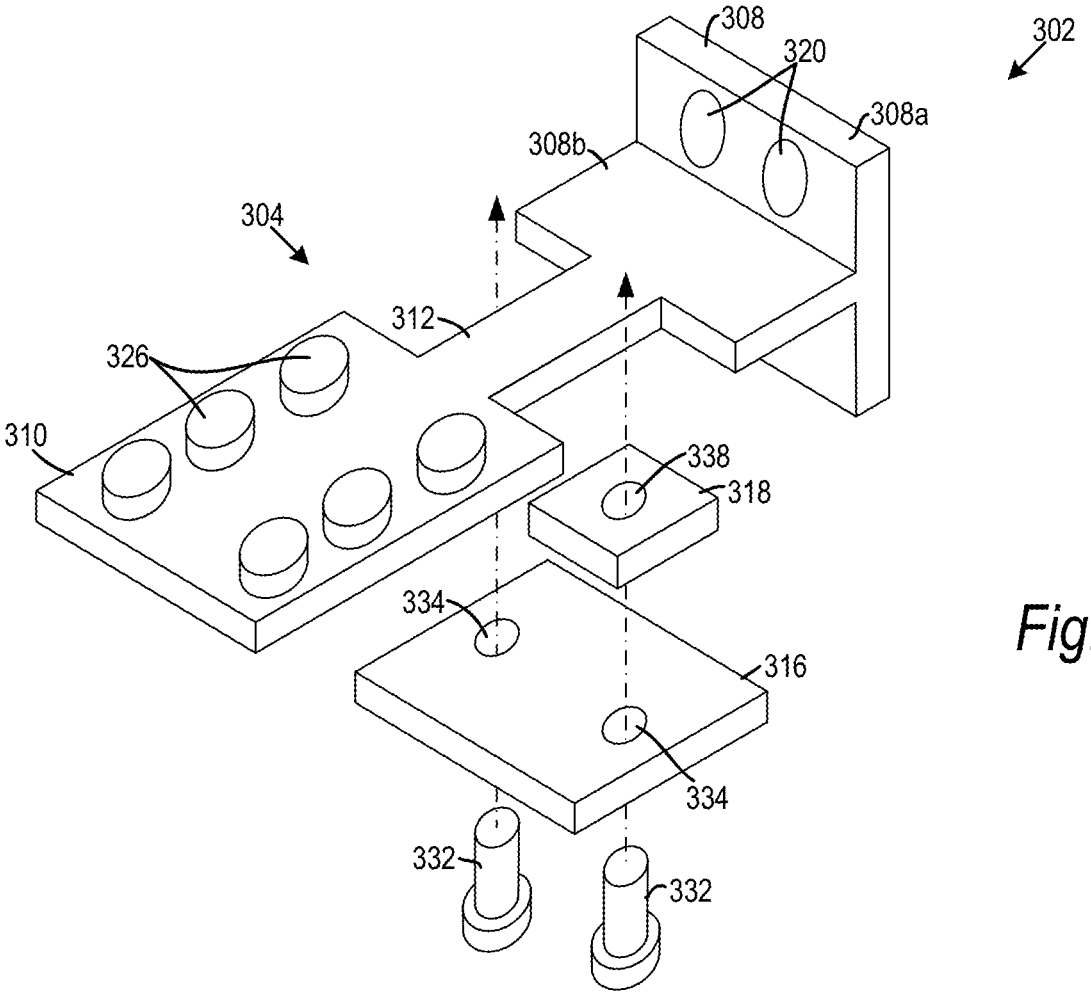
FIG. 7 is an exploded perspective view of a buckling restraint assembly according to embodiments of the present technology.

The beam 102 is affixed to the column 104 by means of a lateral bracing system 300. The lateral bracing system is comprised of a pair of buckling-restrained braced devices 302, one on each of the top and bottom flanges 110 of beam 102. Each buckling-restrained braced device 302 may include a flat, "dog-bone" shaped yield member 304 (FIG. 7) bolted, welded or glued at its first end to a flange 110 of the beam 102 and bolted, welded or glued at its second end to a flange of the column 104 ("dog bone" shaped in that it is narrower at a center portion 312 than at its end portions). Covering the center portion of each yield member 304 is a buckling restraint block 316. Blocks 316 are bolted, welded or glued to the respective flanges 110 of the beam 102. For example, FIG. 7 shows bolts 332 fitting holes 334 in the buckling restraint block.

A shear tab 222 may further be provided between the beam 102 and column 104. The shear tab 222 may be affixed as by bolting, welding or gluing to a flange of column 104 and as by bolting to the central diaphragm 112 of beam 102. As shown, the shear tab 222 may include bolt holes 228 comprising a central bolt hole **228*a* and a pair of edge bolt holes 228*b*. The central bolt hole 228*a* may be circular, while the edge bolt holes 228*b* may be oblong, with a length dimension oriented parallel to the flanges 110 of beam 102** when assembled. As explained below, upon lateral loads of sufficient magnitude, the beam 102 may rotate about an axis through central bolt hole 228*a*. The oblong edge bolt holes 228*b* allow translation of the bolts affixed to the central diaphragm of the beam 102 within the edge bolt holes upon rotation of the beam 102 relative to column 104.

In operation, the pair of buckling-restrained braced devices 302 operate in tandem to oppose rotation of the beam relative to the column (i.e., rotation about the central hole 228*a* of shear tab 222) under a lateral loads. Attempted rotation in a first direction will place the first of the devices 302 in tension and the second of the devices in compression. Attempted rotation in the opposite direction will place the first of the devices in compression and the second in tension.

The yield member 304 of the respective devices 302 provides high initial stiffness and tensile resistance to relative movement between the column 104 and the beam 102 under lateral loads, but provides stable yielding and energy dissipation under lateral loads above a predictable and controlled level. In particular, the bending strength of the column and beam could be designed to exceed the moment capacity of the yield members 304, and in particular, the thinner center portions of yield members 304. Thus, the yield members 304 yield under lateral loads before yielding or failure of the column or beam, and any damage is limited to the yield links which may be easily removed and replaced. The buckling restraint blocks 316 prevent buckling of the yield members under a compressive load. The shear tab 222 is provided to oppose vertical shear (i.e., along the length of column 104) under a vertical load or as created during lateral loading of the bracing system. The shear tab 222 is also provided to oppose axial force (i.e., along the length of beam 102) under a lateral load in the bracing system.

Figure 4:
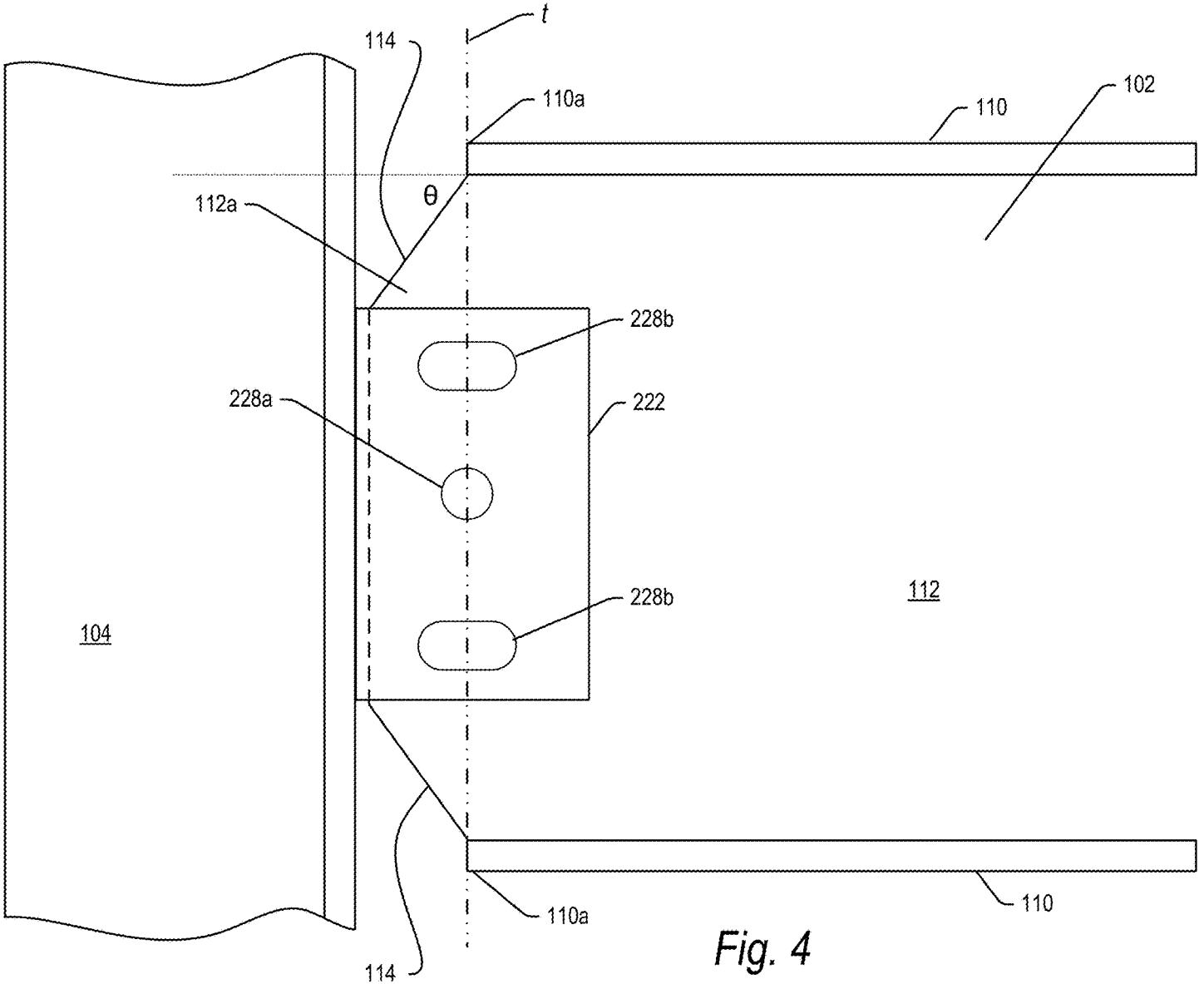
FIG. 4 is a front view of a beam situation next to a column illustrating coping of the beam according to embodiments of the present technology.

As noted in the Background, it is one advantage of the present technology to avoid interferences and binding of components as the beam 102 pivots relative to column 104 under lateral loads. For example, in one embodiment, the beam 102 is coped at its end adjacent the column 104 to include angled sections 114 (as numbered for example in FIG. 4). As explained below, each yield member 304 may include a vertical plate 308*a* mounted to the column 104. In embodiments, the angled sections 114 remove portions of the top and bottom flanges 110 of beam 102 that may otherwise interfere with, or bind against, the column-mounted plate 308 of yield member 304 upon rotation of the beam 102.

The angle sections 114 define an extended web section 112*a* to which the shear tab 222 is bolted. Each angled section 114 may form an angle, θ, with the flange 110 which may vary between 80° and 40°, such as for example 60°, those the angle θ may be lesser or greater than that in further embodiments. In embodiments, the flanges may be coped so that each flange 110 may end (and the angled section 114 begins) at an endpoint 110*a* that is, for example, 3 inches from the distal edge of the extended web section 112*a*. This position is aligned along a transverse (vertical) axis, t, orthogonal to the surface of flanges 110, which passes through a center point of the center bolt hole 228*a*. However, it is possible that the endpoint 110*a* of each flange 110 may end at a point that is spaced forward or back from the transverse axis t. For example, each flange may end at a point that is $\frac{1}{8}^{th}$ inch or $\frac{1}{16}^{th}$ inch forward or back from the transverse axis t. The endpoints 110*a* of flanges 110 may end at points that are spaced other distances from the transverse axis tin further embodiments.

Coping the beam 102 in this manner provides advantages in that, without coping the beam 102 as described above, the flanges 110 can bear against, interfere with or bind against the column-mounted plate 308. Since the plate 308 can offer a fair amount of resistance to this action, forces build within the beam which create additional unwanted shear forces in the bolts on the shear tab 222. Additionally, by bearing against the column-mounted plate 308, unwanted forces are generated on the column-mounted plate 308 and yield member 304, as well as the bolts, weld or glue fastening the column-mounted plate 308 to column 104.

Figure 5:
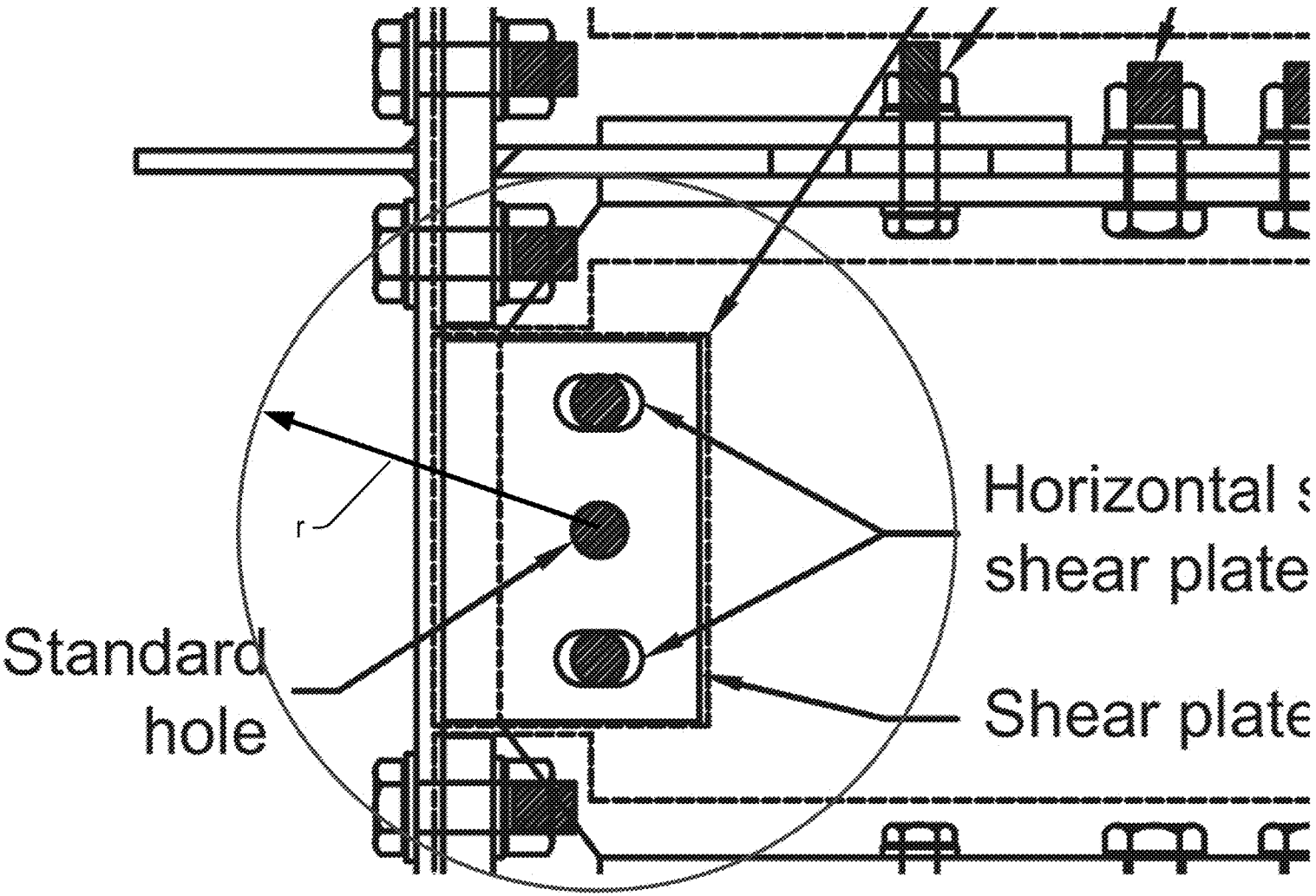
FIG. 5 is an enlarged front view of a portion of a beam, column and shear tab according to embodiments of the present technology.

However, by coping the beam 102 as described herein, these problems are avoided. FIG. 5 shows a radius, r, followed by the endpoint 110*a* of a flange 110 as the beam rotates about the central bolt hole 228*a*. As shown, when the beam rotates in either direction when coped as described herein, there is no contact with column-mounted plate 308.

Figure 6:
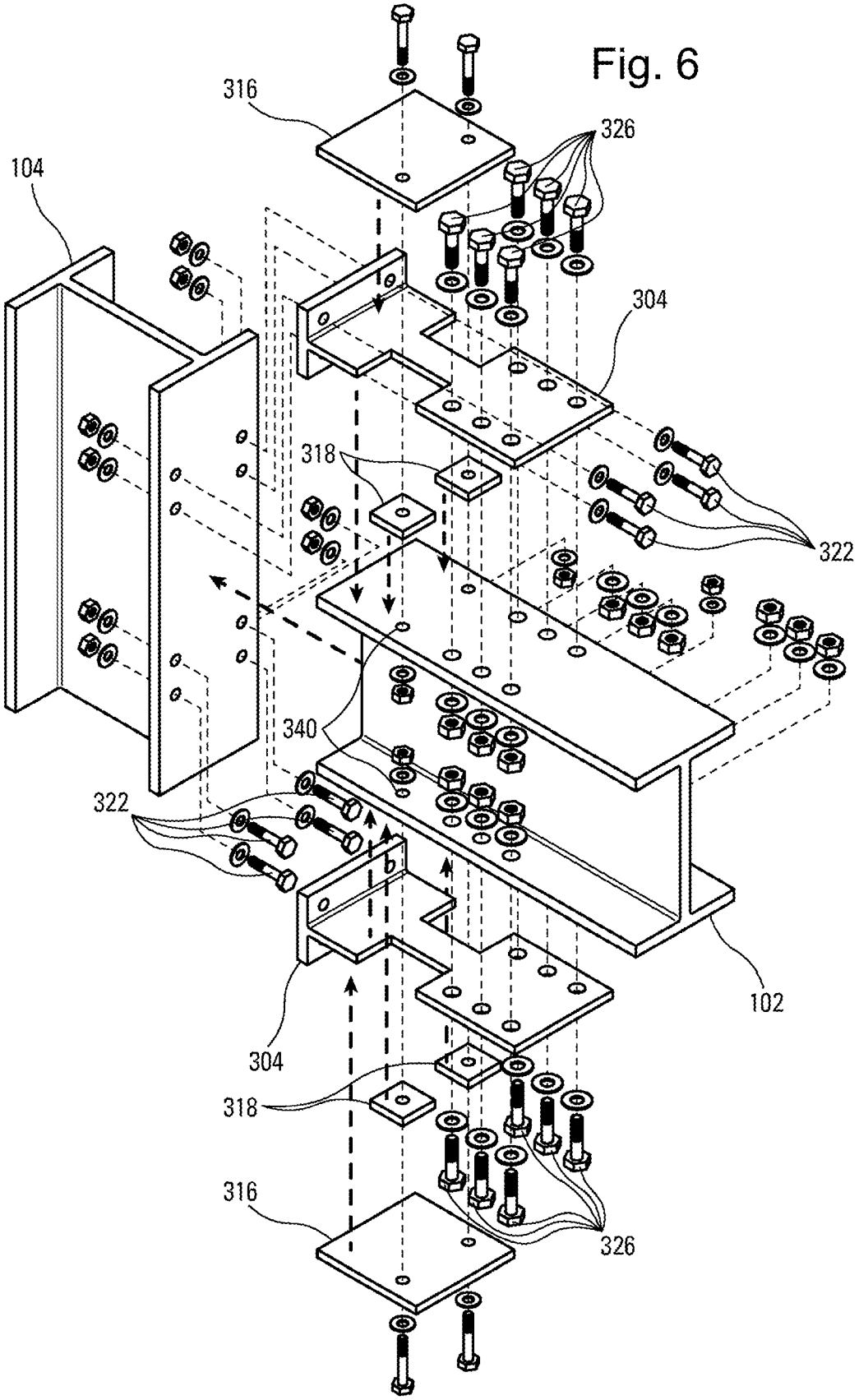
FIG. 6 is an exploded perspective view of a buckling restraint assembly and coped beam according to embodiments of the present technology.

FIGS. 6 and 7 provide greater detail of the lateral bracing system 300 and yield member 304. Each yield member 304 includes a column-mounted plate 308, a beam-mounted plate 310, and a yield plate 312 connected between the column-mounted plate and beam-mounted plate. The column-mounted plate 308 may have a vertical portion 308*a* and a horizontal portion 308*b* that may be welded together at a right angle. The vertical and horizontal portions 308*a*, 308*b* may be affixed to each other by other means, or cast as a single piece in further embodiments.

The horizontal portion 308*b* may be formed of a flat, unitary construction with beam-mounted plate 310 and yield plate 312. The horizontal portion 308*b* and plates 308, 310 and 312 may for example be formed from a single piece of ¼ inch steel. The horizontal portion 308*b* and plates 308, 310 and 312 may for example be formed to other thicknesses in further embodiments.

The column-mounted plate 308 and beam-mounted plate 310 may each have a width (across the width of the flanges of beam 102) approximately equal to the width of the flanges of beam 102, such as for example 7.00 inches. The yield plate 312 may have a width (across the width of the flanges of beam 102) that is less than the width of the plates 308, 312. The width of plate 312 may be between 1 and 6 inches in an embodiment, between 1 and 3 inches in a further embodiment, and between 2 and 3 inches in a further embodiment. The width of yield plate 312 may be other dimensions, with the provision that the yield plate have a smaller width than the column and beam-mounted plates 308, 310.

The buckling-retrained assembly 302 further includes a buckling restraint member 316 and a pair of spacer blocks 318 (one of which is omitted from FIG. 7 for clarity). The buckling restraint member 316 may be a flat plate with a length (along a length of beam 102) approximately equal to a length of the yield plate 312. The buckling restraint member 316 may be longer or shorter than the yield plate 312 in further embodiments. The buckling restraint member 316 may be ¼ inch steel, though it may be thicker or thinner in further embodiments.

The spacer blocks 318 are sized to fit in between the horizontal portion 308*b* of column-mounted plate 308 and beam-mounted plate 310, on either side of yield plate 312, when the buckling-retrained assembly 302 is assembled together as explained below. The spacer blocks 318 may have the same thickness as the yield member 304.

The yield member 304 including column-mounted plate 308, beam-mounted plate 310, and yield plate 312 may be affixed to the column 104, either at the jobsite or remote from the jobsite. In one embodiment, the vertical portion 308*a* includes holes 320 (FIG. 7) for receiving bolts 322 (FIG. 6) above and below the horizontal portion 308*b* so that the yield member 304 may bolt to the column 104. In further embodiments, it is contemplated that the yield member 304 may alternatively be affixed to the column 104 by welding or gluing.

Thereafter, at the jobsite, the beam-mounted plate 310 may be bolted to the beam 102 via a plurality of bolts 326. While the figures show six bolts 326, there may be more or less than that in further embodiments. At this point, the yield member 304 is affixed to both the beam 102 and column 104. The beam and column may also be attached to each other by a shear tab 222 as described above. Shear tab 222 may be affixed to the column 104 as by welding, gluing or bolting to a flange of column 104 and to the web of beam 102 as by bolts.

In embodiments, the buckling restraint assemblies 302 and shear tab 222 may affix beam 102 to column 104 at the jobsite with bolts only, thus simplifying construction by omitting welding. However, in further embodiments, the beam-mounted plate 310 and/or shear tab 222 may be affixed to beam 102 by welding or gluing. In further embodiments, the yield member 304 may be affixed to the beam 102 first, either before or at the jobsite, and then affixed to the column 104.

Although the invention has been described in detail herein, it should be understood that the invention is not limited to the embodiments herein disclosed. Various changes, substitutions and modifications may be made thereto by those skilled in the art without departing from the spirit or scope of the invention as described and defined by the appended claims.

What is claimed is:

1. A construction, comprising:

a vertical column;

a horizontal beam including a top flange and a bottom flange, and a web between the top and bottom flange;

a shear tab having a length oriented vertically and affixed between the column and beam, between the top and bottom flange of the beam, the shear tab comprising a bolt hole;

a lateral bracing system affixed between the column and beam, including:

first and second buckling restraint assemblies, one each on the top and bottom flange of the beam, each buckling restraint assembly including:

a column mounted plate including a horizontal portion and a vertical portion, the vertical portion affixed to the column, a beam mounted plate including a horizontal portion mounted to the beam, and a yield plate connected between the column mounted plate and the beam mounted plate, the yield plate having a smaller width than the column mounted plate and the beam mounted plate, the smaller width of the yield plate defining first and second notches on opposite sides of the yield plate, between the column mounted plate and beam mounted plate, the yield plate yielding in tension and compression to dissipate stress within the construction upon a lateral load applied to the beam and/or column;

first and second coped sections in the web configured to prevent binding of the top and bottom flanges with the column-mounted plate upon rotation of the beam relative to the column, the top flange terminating at a first end of the first coped section, the first coped section including a second end terminating at the shear tab, the top flange terminating along a vertical axis that passes through a center of the shear tab bolt hole.

2. The construction of claim 1, wherein the bottom flange terminates at a first end of the second coped section, where the second coped section meets the bottom beam flange.

3. The construction of claim 2, wherein the second coped section has a second end terminating at the shear tab.

4. The construction of claim 1, wherein one or more coped sections form an angle of between 80° and 40° with the top and/or bottom flange.

5. The construction of claim 1, wherein one or more coped sections form an angle of 60° with the top and/or bottom flange.

* * * * *